US006856961B2

(12) United States Patent
Thyssen

(10) Patent No.: US 6,856,961 B2
(45) Date of Patent: Feb. 15, 2005

(54) SPEECH CODING SYSTEM WITH INPUT SIGNAL TRANSFORMATION

(75) Inventor: Jes Thyssen, Laguna Niguel, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 647 days.

(21) Appl. No.: 09/782,884

(22) Filed: Feb. 13, 2001

(65) Prior Publication Data

US 2002/0156625 A1 Oct. 24, 2002

(51) Int. Cl.[7] ..... G10L 19/00
(52) U.S. Cl. ..... 704/500; 704/215
(58) Field of Search ..... 704/500, 215, 704/221, 207, 201, 229, 230, 210

(56) References Cited

U.S. PATENT DOCUMENTS 5,652,712 A * 7/1997 Szczebak et al. ..... 702/85
6,044,068 A * 3/2000 El Malki ..... 370/286
6,564,060 B1 * 5/2003 Hoagland ..... 455/450
6,564,182 B1 * 5/2003 Gao ..... 704/207
6,606,355 B1 * 8/2003 Wei ..... 375/242
6,636,829 B1 * 10/2003 Benyassine et al. ..... 704/201

* cited by examiner

*Primary Examiner*—Daniel Abebe
(74) *Attorney, Agent, or Firm*—Farjami & Farjami LLP

(57) ABSTRACT

The invention provides a speech coding system with input signal transformation that may reduce or essentially eliminate "silence noise" from the input or speech signal. The speech coding system may comprise an encoder disposed to receive an input signal. The encoder ramps the input signal to a zero-level when a portion of the input signal comprises silence noise.

23 Claims, 3 Drawing Sheets

SPEECH CODING SYSTEM WITH INPUT SIGNAL TRANSFORMATION

BACKGROUND OF THE INVENTION

1. Technical Field

This invention relates generally to digital coding systems. More particularly, this invention relates to input transformation systems for speech coding.

2. Related Art

Telecommunication systems include both landline and wireless radio systems. Wireless telecommunication systems use radio frequency (RD.) communication. Currently, the frequencies available for wireless systems are centered in frequency ranges around 900 MHz and 1900 MHz. The expanding popularity of wireless communication devices, such as cellular telephones is increasing the RD. traffic in these frequency ranges. Reduced bandwidth communication would permit more data and voice transmissions in these frequency ranges, enabling the wireless system to allocate resources to a larger number of users.

Wireless systems may transmit digital or analog data. Digital transmission, however, has greater noise immunity and reliability than analog transmission. Digital transmission also provides more compact equipment and the ability to implement sophisticated signal processing functions. In the digital transmission of speech signals, an analog-to-digital converter samples an analog speech waveform. The digitally converted waveform is compressed (encoded) for transmission. The encoded signal is received and decompressed (decoded). After digital-to-analog conversion, the reconstructed speech is played in an earpiece, loudspeaker, or the like.

The analog-to-digital converter uses a large number of bits to represent the analog speech waveform. This larger number of bits creates a relatively large bandwidth. Speech compression reduces the number of bits that represent the speech signal, thus reducing the bandwidth needed for transmission. However, speech compression may result in degradation of the quality of decompressed speech. In general, a higher bit rate results in a higher quality, while a lower bit rate results in a lower quality.

Modern speech compression techniques (coding techniques) produce decompressed speech of relatively high quality at relatively low bit rates. One coding technique attempts to represent the perceptually important features of the speech signal without preserving the actual speech waveform at a constant bit-rate. Another coding technique, a variable-bit rate encoder, varies the degree of speech compression depending on the part of the speech signal being compressed. Typically, perceptually important parts of speech (e.g., voiced speech, plosives, or voiced onsets) are coded with a higher number of bits. Perceptually less critical parts of speech (e.g., unvoiced parts or silence between words) are coded with a lower number of bits. The resulting average of the varying bit rates may be relatively lower than a fixed bit rate providing decompressed speech of similar quality. These speech compression techniques lower the amount of bandwidth required to digitally transmit a speech signal.

During speech coding, these speech compression techniques also code "silence noise" in addition to the voice and other sounds received on an input signal. Silence noise typically includes very low-level ambient noise or sounds such as electronic circuit noise induced in the analog path of the input or speech signal before analog to digital conversion. Silence noise generally has very low amplitude. However, many companding operations such as those using A-law and $\mu$-law have poor resolution at very low levels. Silence noise becomes amplified and thus an annoying component of the speech input signal to the speech coding system. If not removed from the input or speech signal prior to speech coding, silence noise becomes more annoying with decreasing bit-rate. The annoying effect of silence noise becomes compounded in configurations such as a typical PSTN where companding typically precedes and succeeds the speech coding.

SUMMARY

The invention provides a speech coding system with input signal transformation that adaptively detects whether a frame or other portion of the input signal comprises "silence noise". If silence noise is detected, the input signal may be ramped or maintained at the zero-level of the signal. Otherwise, the input signal may not be modified or may be ramped-up from the zero-level.

In one aspect, the speech coding system with input signal transformation comprises an encoder disposed to receive an input signal. The encoder provides a bitstream based upon a speech coding of a portion of the input signal. The encoder ramps the input signal to a zero-level when a portion of the input signal comprises silence noise.

In a method of transforming an input signal in a speech coding system, zero-level and at least one quantization level of the input signal are adaptively tracked. One or more silence detection parameters are calculated. The silence detection parameters are compared to one or more thresholds. A determination is made whether the input signal comprises silence noise. The input signal is ramped to a zero-level when the input signal comprises silence noise.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
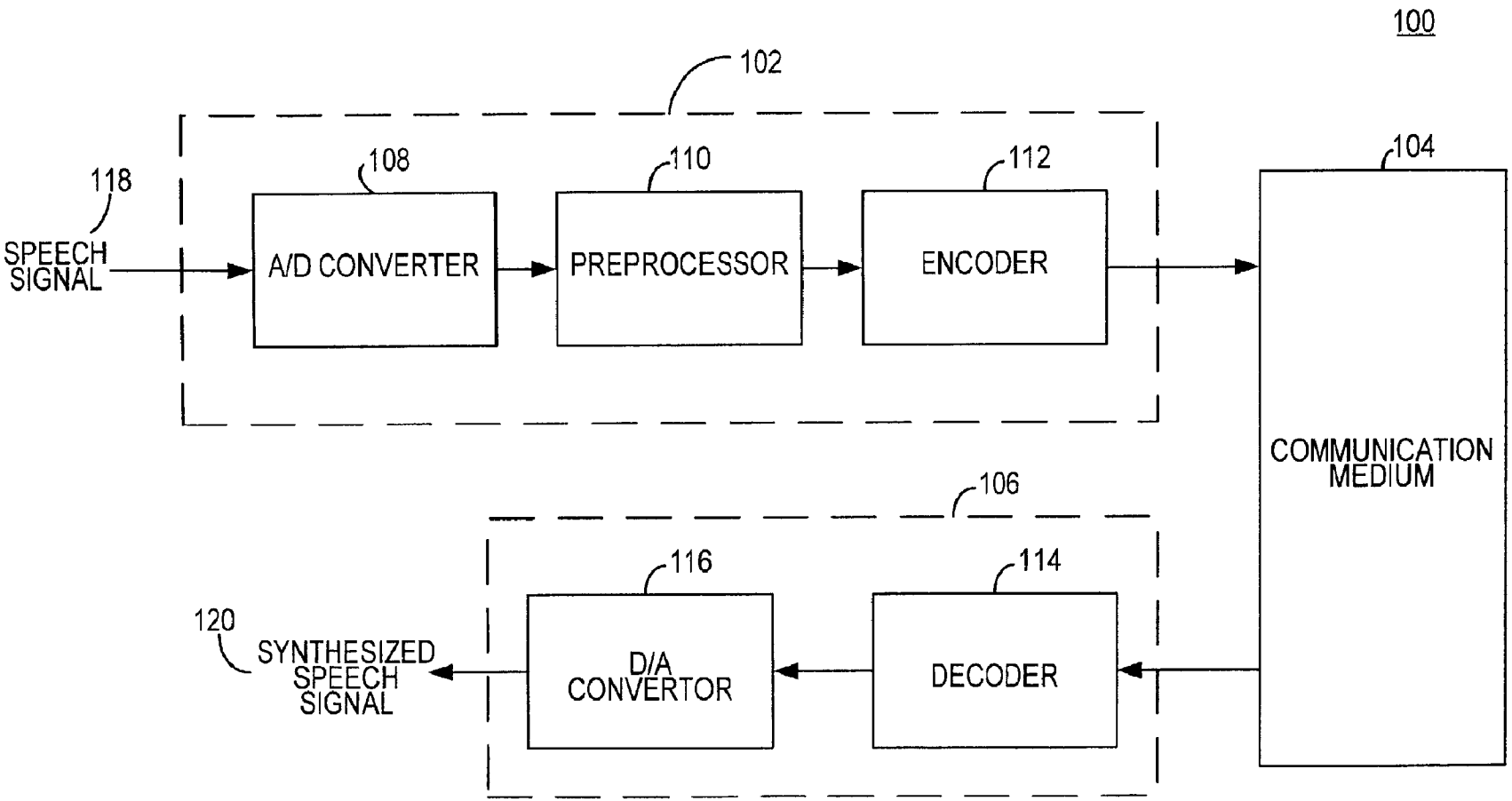
FIG. 1 is a block diagram representing a first embodiment of a speech coding system with input signal transformation.

FIG. 1 is a block diagram representing a first embodiment of a speech coding system 100 with input signal transformation. The speech coding system 100 includes a first communication device 102 operatively connected via a communication medium 104 to a second communication device 106. The speech coding system 100 may be any cellular telephone, radio frequency, or other telecommunication system capable of encoding a speech signal 118 and decoding it to create synthesized speech 120. The communication devices 102 and 106 may be cellular telephones, portable radio transceivers, and other wireless or wireline communication systems. Wireline systems may include Voice Over Internet Protocol (VoIP) devices and systems.

The communication medium 104 may include systems using any transmission mechanism, including radio waves, infrared, landlines, fiber optics, combinations of transmission schemes, or any other medium capable of transmitting digital signals. The communication medium 104 also may include a storage mechanism including a memory device, a storage media or other device capable of storing and retrieving digital signals. In use, the communication medium 104 transmits digital signals, including a bitstream, between the first and second communication devices 102 and 106.

The first communication device 102 includes an analog-to-digital converter 108, a preprocessor 110, and an encoder 112. Although not shown, the first communication device 102 may have an antenna or other communication medium interface (not shown) for sending and receiving digital signals with the communication medium 104. The first communication device 102 also may have other components known in the art for any communication device.

The second communication device 106 includes a decoder 114 and a digital-to-analog converter 116 connected as shown. Although not shown, the second communication device 106 may have one or more of a synthesis filter, a postprocessor, and other components known in the art for any communication device. The second communication device 106 also may have an antenna or other communication medium interface (not shown) for sending and receiving digital signals with the communication medium 104.

The preprocessor 110, encoder 112, and/or decoder 114 may comprise processors, digital signal processors, application specific integrated circuits, or other digital devices for implementing the algorithms discussed herein. The preprocessor 110 and encoder 112 also may comprise separate components or a same component.

In use, the analog-to-digital converter 108 receives an input or speech signal 118 from a microphone (not shown) or other signal input device. The speech signal may be a human voice, music, or any other analog signal. The analog-to-digital converter 108 digitizes the speech signal, providing a digitized signal to the preprocessor 110. The preprocessor 110 passes the digitized signal through a high-pass filter (not shown), preferably with a cutoff frequency of about 80 Hz. The preprocessor 110 may perform other processes to improve the digitized signal for encoding.

The encoder 112 segments the digitized speech signal into frames to generate a bitstream. The speech coding system 100 may use frames having 160 samples and corresponding to 20 milliseconds per frame at a sampling rate of about 8000 Hz. The encoder 112 provides the frames via a bitstream to the communication medium 104. Alternatively, the encoder may receive the input signal already in digital format from a decoder or other device using A-law, $\mu$-law, or another coding means.

The decoder 114 receives the bitstream from the communication medium 104. The decoder 114 operates to decode the bitstream and generate a reconstructed speech signal in the form of a digital signal. The reconstructed speech signal is converted to an analog or synthesized speech signal 120 by the digital-to-analog converter 116. The synthesized speech signal 120 may be provided to a speaker (not shown) or other signal output device.

In this embodiment, the first communication device 102 includes an input signal transformation (not shown) that may be part of or otherwise incorporated with the A/D converter, the preprocessor, the encoder, or another component. In one aspect, the input signal transformation occurs prior to other signal processing when the input signal is a "raw" signal—in an as-received form. If the signal passes through any processing before the input signal transformation such as a high-pass filter, it may no longer be possible to identify the preceding processing and the quantization levels. The input signal transformation adaptively tracks the quantization levels and zero-level of the input or speech signal. The input signal transformation may be fixed for use with one or more of A-law, $\mu$-law, or other coding. The input transformation adaptively detects on a frame basis whether the current frame, which may be in the range of about 10 milliseconds through about 20 milliseconds, is silence and whether the component is silence noise. If silence noise is detected, the input signal is selectively set—ramped or maintained—at the zero-level of the signal. Otherwise, the input signal is not modified or is ramped from the zero-level of the signal. The zero-level of the signal depends on the signal processing prior to speech coding. The signal processing may be unknown, may change, and may be fixed on one or more of A-law, $\mu$-law, or other coding. In one aspect, the zero-level for A-law processing has a value of about 8. In another aspect, the zero-level for $\mu$-law has a value of about 0. In yet another aspect, the zero-level for a 16 bit linear PCM has a value of about 0.

Figure 2:
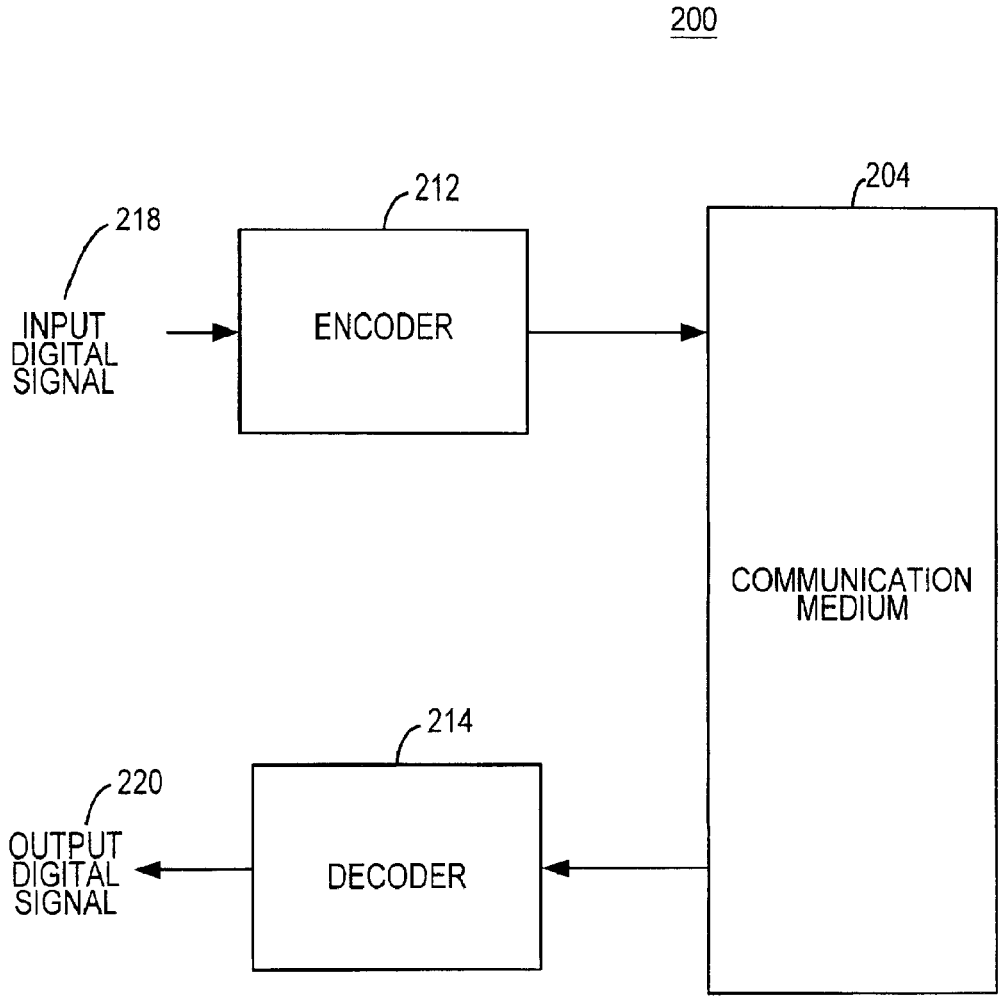
FIG. 2 is a block diagram representing a second embodiment of a speech coding system with input signal transformation.

FIG. 2 is a block diagram representing a second embodiment of a speech coding system 200 with input signal transformation. The speech coding system 200 includes an encoder 212 operatively connected via a communication medium 204 to a decoder 214. The speech coding system 200 may be any wireline, wireless, combination of wireline and wireless, or other telecommunication system capable of encoding and decoding a digital signal. The speech coding system 200 may include or be part of a cellular telephone system, a portable radio system, an Internet system, and Voice Over Internet Protocol (VoIP) system.

The communication medium 204 may include systems using any transmission mechanism, including radio waves, infrared, landlines, fiber optics, combinations of transmission schemes, or any other medium capable of transmitting digital signals. The communication medium 204 also may include a storage mechanism including a memory device, a storage media or other device capable of storing and retrieving digital signals. In use, the communication medium 204 transmits digital signals including a bitstream between the encoder 212 and decoder 214.

In use, the encoder 212 receives an input digital signal that may be provided by another decoder (not shown) or other device using A-law, or $\mu$-law, or another coding means. The encoder 212 has an input signal transformation as previously discussed. The input signal transformation may occur prior to other signal processing by the encoder 212. In one aspect, the input signal transformation reduces or eliminates silence noise from the input digital signal. The encoder 212 segments the input digital signal into frames to generate a bitstream. The speech coding system 200 may use frames having 160 samples and corresponding to 20 milliseconds per frame at a sampling rate of about 8000 Hz. The encoder 212 provides the frames via a bitstream to the communication medium 204. The decoder 214 receives the bitstream from the communication medium 204. The decoder 214 operates to decode the bitstream and generate an output digital signal. The output digital signal may be converted to an analog or synthesized speech signal. The output digital signal may undergo additional signal processing such as another signal coding system, in which case there may be an additional input signal transformation between the decoder 214 and the other signal coding system.

The encoders 112 and 212 and decoders 114 and 214 use a speech compression system, commonly called a codec, to reduce the bit rate of the digitized speech signal. There are numerous algorithms for speech codecs that reduce the number of bits required to digitally encode the original speech or digitized signal while attempting to maintain high quality reconstructed speech. The code excited linear prediction (CELP) coding technique utilizes several prediction techniques to remove redundancy from the speech signal. The CELP coding approach is frame-based. Sampled input speech signals (i.e., the preprocessed digitized speech signals) are stored in blocks of samples called frames. The frames are processed to create a compressed speech signal in digital form.

The CELP coding approach typically uses two types of predictors, a short-term predictor and a long-term predictor. The short-term predictor is typically applied before the long-term predictor. The short-term predictor also is referred to as linear prediction coding (LPC) or a spectral representation and typically may comprise 10 prediction parameters. A first prediction error may be derived from the short-term predictor and is called a short-term residual. A second prediction error may be derived from the long-term predictor and is called a long-term residual. The long-term residual may be coded using a fixed codebook that includes a plurality of fixed codebook entries or vectors. During coding, one of the entries may be selected and multiplied by a fixed codebook gain to represent the long-term residual. The long-term predictor also can be referred to as a pitch predictor or an adaptive codebook and typically comprises a lag parameter and a long-term predictor gain parameter.

A CELP encoder performs an LPC analysis to determine the short-term predictor parameters. Following the LPC analysis, the long-term predictor parameters and the fixed codebook entries that best represent the prediction error of the long-term residual are determined. Analysis-by-synthesis (ABS) is employed in CELP coding. In the ABS approach, synthesizing with an inverse prediction filter and applying a perceptual weighting measure find the best contribution from the fixed codebook and the best long-term predictor parameters.

The short-term LPC prediction coefficients, the adjusted fixed-codebook gain, as well as the lag parameter and the adjusted gain parameter of the long-term predictor are quantized. The quantization indices, as well as the fixed codebook indices, are sent from the encoder to the decoder.

A CELP decoder uses the fixed codebook indices to extract a vector from the fixed codebook. The vector is multiplied by the fixed-codebook gain, to create a fixed codebook contribution. A long-term predictor contribution is added to the fixed codebook contribution to create a synthesized excitation that is commonly referred to simply as an excitation. The long-term predictor contribution comprises the excitation from the past multiplied by the long-term predictor gain. The addition of the long-term predictor contribution alternatively comprises an adaptive codebook contribution or a long-term pitch filtering characteristic. The excitation is passed through a synthesis filter, which uses the LPC prediction coefficients quantized by the encoder to generate synthesized speech. The synthesized speech may be passed through a post-filter that reduces the perceptual coding noise. Other codecs and associated coding algorithms may be used, such as adaptive multi rate (AMR), extended code excited linear prediction (eX-CELP), selectable mode vocoder (SMV), multi-pulse, regular pulse, and the like.

Figure 3:
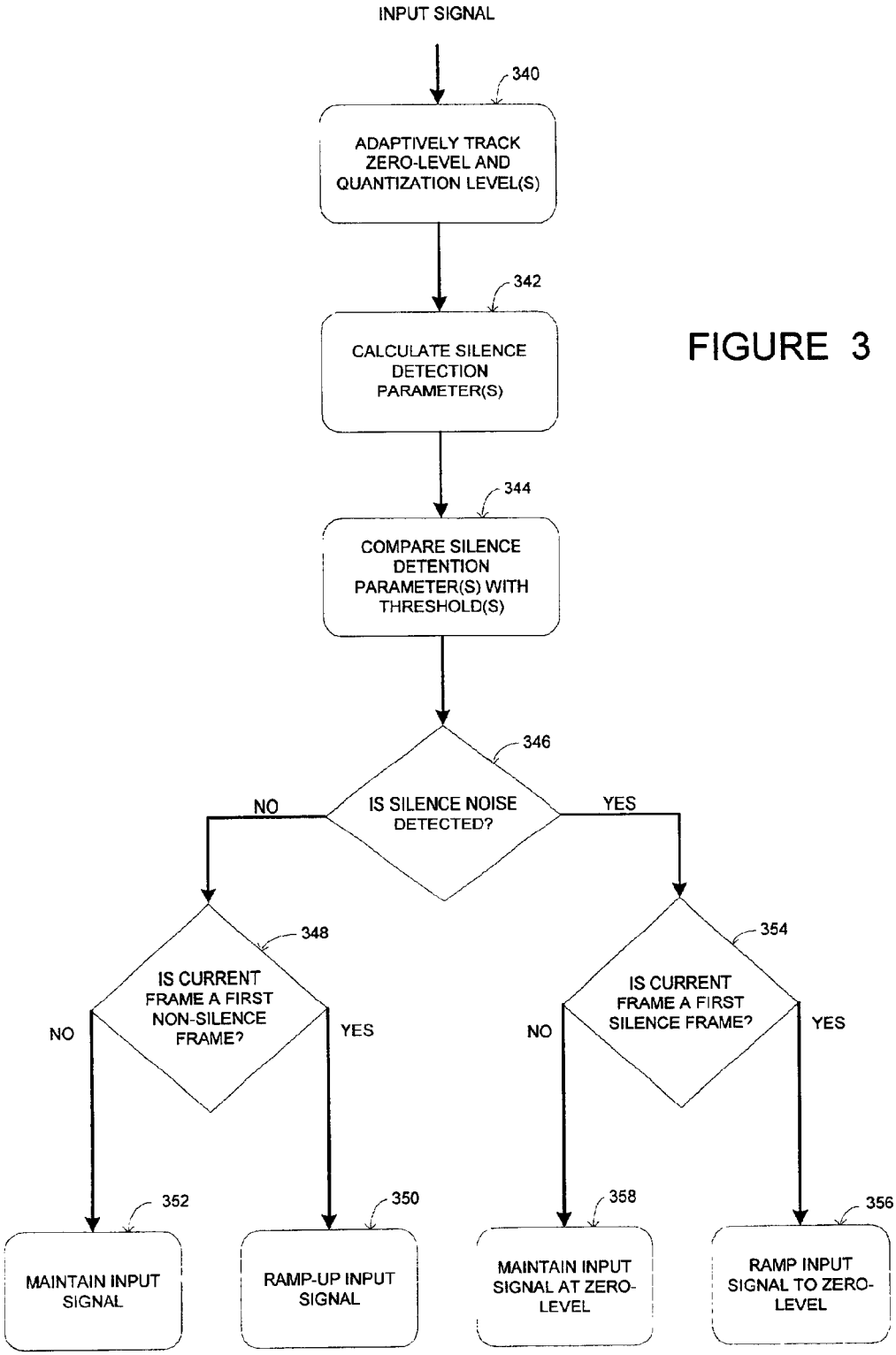
FIG. 3 is a flowchart representing a method of transforming an input signal in a speech coding system.

FIG. 3 shows a method of transforming an input signal in a speech coding system. In 340, the zero-level and one or more quantization levels of the input signal are adaptively tracked. The zero-level of the input signal depends on the signal processing prior to speech coding. The zero-level is the minimum absolute signal value according to the prior processing. A-law processing has a zero-value of about 8. $\mu$-law has a zero-value of about 0. A 16 bit linear PCM has a zero-value of about 0. The signal processing may be unknown and may change as the input signal changes.

Quantization levels are positions in relation to the zero-level where samples of the input signal may be located. In one embodiment, the input signal transformation adaptively tracks four quantization levels—$l_{2pos}$, $l_{1pos}$, $l_{1neg}$, and $l_{2neg}$ of the input signal. The objective is to identify the quantization levels of the input signal where $l_{1pos}$ is the smallest positive sample value, $l_{2pos}$ is the second smallest positive sample value, $l_{1neg}$ is the smallest absolute negative sample value, and $l_{2neg}$ is the second smallest absolute negative sample value. In one aspect of an input signal processed by A-law, the quantization levels are as follows:

$l_{1\,pos}$: +24

$l_{2\,pos}$: +8

$l_{1\,neg}$: −8

$l_{2\,reg}$: −24

Additional or fewer quantization levels may be tracked. Additional quantization levels generally will provide finer resolution. Fewer quantization levels generally will provide coarser resolution.

In 342, one or more silence detection parameters are calculated. The silence detection parameters may be based on the zero-level and the one or more quantization levels of the input signal. The silence detection parameters also may be based on additional or other factors. In one embodiment, the input signal transformation uses three silence detection parameters or frame rates—zero_rate, low_rate, and high_rate. In one aspect, the frame rates represent the portion of samples, x(n), of the input signal within a quantization interval defined by the adaptively tracked quantization levels.

The zero_rate may be calculated as follows:

$$\frac{N_0}{N}$$

where N is the number of samples in a frame of the input signal, where $N_0$ is the number of samples in the frame in which $0 \leqq x(n) \leqq l_{1pos}$, and $$0 \leq \frac{N_0}{N} \leq 1.0.$$

The low_rate may be calculated as follows:

$$\frac{N_1}{N}$$

where N is the number of samples in a frame of the input signal, where $N_1$ is the number of samples in the frame in which $l_{1neg} \leqq x(n) \leqq l_{1pos}$, and $$0 \leq \frac{N_1}{N} \leq 1.0.$$

The high_rate may be calculated as follows:

$$\frac{N_2}{N}$$

where N is the number of samples in a frame of the input signal, where $N_2$ is the number of samples in the frame in which $x(n) \geqq l_{2pos}$ or $x(n) \leqq l_{2neg}$; and $$0 \leq \frac{N_2}{N} \leq 1.0.$$

From the frame rates, the level of silence may be assessed. There may be little silence when the zero_rate is low, the low_rate is low, and the high_rate is high. Conversely, there may be mostly silence when the zero_rate is high, the low_rate is high, and the high_rate is low.

In 344, the silence detection parameters are compared to thresholds to determine whether the frame or other portion of the input signal contains silence noise. The silence detention parameters may be compared to the thresholds individually or in combination. The silence detection parameters from the current frame and one or more preceding frames also may be compared to the thresholds. In one aspect, the zero_rate, the low_rate, and the high_rate are compared to a first threshold, a second threshold, and a third threshold, respectively. In another aspect, the zero_rate, the low_rate, and the high_rate are compared to a fourth threshold, a fifth threshold, and a sixth threshold, respectively. In yet another aspect, the zero_rate[0], the low_rate [0], the high_rate[0], the zero_rate[1], the low_rate [1], the high_rate[1], the zero_rate[2], the low_rate[2], the high_rate[2] (where 0 designates the current frame, 1 designates the first preceding frame, and 2 designates the second preceding frame) are compared to the first threshold, the second threshold, and the third threshold, respectively. Silence may be detected when all or a portion of the silence detection parameters are beyond or within their respective thresholds. When any or all of the frame rates are beyond or within their respective thresholds, "silence noise" maybe detected in a frame. In 346, a determination is made to determine whether the frame or other portion of the input signal includes "silence noise". If there is no "silence noise" detected, then another determination may be made in 348 to determine whether the current frame is a first non-silence frame (i.e., the preceding frame is a silence frame). If the current frame is a first non-silence frame, then the input signal is ramped-up in 350. If the current frame is not a first non-silence frame, then there is no change to the input signal in 352. If there is silence noise detected, then another determination may be made in 354 to determine whether the current frame is a first silence frame (i.e., the preceding frame is a non-silence frame). If the current frame is a first silence frame, then the input signal is ramped-down to the zero-level for the input signal in 356. If the current frame is not a first silence frame, then the input signal is maintained at the zero-level in 358.

In one aspect of this method, the input signal is ramped-up from the zero-level or ramped-down to the zero-level depending upon whether the current frame or portion of the input signal is the first non-silence frame or the first silence frame. The input signal is not changed when there are consecutive non-silence frames. The input signal is ramped-up from the zero-level when the current frame is the first non-silence frame. The input signal is maintained at the zero-level when there are consecutive silence frames. The input signal is ramped down to the zero-level when the current frame is the first silence frame. The ramping-up or ramping-down may extend beyond the current frame.

Another method of transforming an input signal in a speech coding system utilizes the following computer code, written in the C programming language. The C programming language is well known to those having skill in the art of speech coding and speech processing. The following C programming language code may be performed by the method shown in FIG. 3.

```
/*==================================================
*/
/*FUNCTION:        PPR_silence_enhan ()                    */
/*-------------------------------------------------------------------------------
*/
/*PURPOSE :        This function performs the enhancement of the  */
/*        silence in the input frame.          */
/*-------------------------------------------------------------------------------
*/
/*INPUT ARGUMENTS :                    */
/*        _(FLOAT64 []) x_in:  input speech frame      */
/*        _(INT16 ) N :        speech frame size.      */
/*-------------------------------------------------------------------------------
*/
/*OUTPUT ARGUMENTS:                    */
/*   _(FLOAT64 []) x_out:     output speech frame          */
/*-------------------------------------------------------------------------------
*/
/*RETURN ARGUMENTS:                    */
/*   _None.                    */
/*==================================================
*/
void   PPR_silence_enhan (FLOAT64 x_in [], FLOAT x_out [],
       INT16 n)
       {
       /*-------------------------------------------------------------------------*/
       INT 16tmp;
       INT16 i, idle_noise;
       INT16 cond1, cond2, cond3, cond4;
       INT16 *hist;
       INT32 delta;
       FLOAT64    *min, *max;
       /*-------------------------------------------------------------------------*/
            hist = svector (0, SE_HIS_SIZE-1);
       max = dvector (0, 1);
            min = dvector (0, 1);
       /*-------------------------------------------------------------------------*/
                 Initialisation
       /*-------------------------------------------------------------------------*/
       min[0] = 32767.0;
       min[1] = 32766.0;
       max[0] = -32767.0;
       max[1] = -32766.0;
       /*-------------------------------------------------------------------------*/
       /*        Loop on the input sample frame                    */
       /*-------------------------------------------------------------------------*/
#ifdefWMOPS
       WMP_cnt_test ( 10*N);
       WMP_cnt_logic ( 3*N);
       WMP_cnt_move( 4*N);
#endif
```

-continued

```
        for(i = 0; i < n; i++)
        {
        /*-------------------------------------------------------------*/
        tmp = (INT16) x_in[i];
        /*-------------------------------------------------------------*/
        /*          Loop on the input sample frame                    */
        /*-------------------------------------------------------------*/
#ifdef WMOPS
        WMP_cnt_test( 10*N);
        WMP_cnt_logic( 3 *N);
        WMP_cnt_move( 4*N);
#endif
        for (i=0; i < N; i++)
            {
        /*-------------------------------------------------------------*/
        tmp = (INT16) x_in[i];
        /*-------------------------------------------------------------*/
        /*          Find the 2 Max values in the input frame          */
        /*-------------------------------------------------------------*/
        if(tmp > max[0])
            {
            max[1] = max[0];
            max[0] = tmp;
            }
        else if((tmp > max [1]) && (tmp < max [0]))
            max [1] = tmp;
        /*-------------------------------------------------------------*/
        /*          Find the 2 Min values in the input frame          */
        /*-------------------------------------------------------------*/
            if (tmp _, min[0])
              {
              min[1] = min[0];
              min[0] = tmp;
              }
            else if((tmp < min[1] && (tmp, > min[0]))
              min[1] = tmp;
        /*-------------------------------------------------------------*/
        /*          Find the 2 Min positive values and the 2 Min      */
        /*          abs. negative values in the input frame           */
        /*-------------------------------------------------------------*/
        if (tmp >= 0)
            {
            if(tmp <low_pos[0])
              {
               low_pos [1] = low_pos [0]
          low_pos[0] = tmp;
          }
      else if((tmp < low_pos [1]) && (tmp > low_pos [0]))
   low_pos [1] = tmp;
}
      else
          {
            if (tmp > low_neg [0]
              {
              low_neg [1] = low_neg [0];
              low_neg [0] = tmp;
              }
          else if((tmp > low_neg (1]) && (tmp < low_neg [0]))
              low_neg [1] = tmp;
        }
         /*-------------------------------------------------------------*/
        }
        /*-------------------------------------------------------------*/
        /*    Calculate the difference between Max and Min            */
        /*-------------------------------------------------------------*/
#ifdef WMOPS
        WMP _cnt _test ( 10);
        WMP _cnt_logic( 3);
        WMP_cnt_move( 5);
#endif
        delta = (INT32) (max[0] > min[0]);
        if((delta < min_delta) && (max [0] > min [0]))
            {
            min_delta = delta;
            if (min_delta <= DELTA_THRLD)
              {
               /*-------------------------------------------------------*/
              if((max[1] >=0.0) && (max[0]>0.0))
                {
```

-continued

```
                11_pos = max [1];
                12_pos = max [0];
                }
              else
                {
                if(low_pos [0] < 32767.0)
                  11_pos = low_pos[0];
                if(low_pos[1] < 32767.0)
                  12_pos = low_pos[1];
                }
               /*-------------------------------------------------------*/
              if((min [0] < 0.0) && (min [1] < 0.0))
                {
                  12 neg = min[0];
                  11_neg = min[1];
                }
              else
                {
                if (low_neg [0] > −32766.0)
                  11_peg = low_neg [0];
                if (low_neg [1] > −32766.0)
                  12_neg = low_neg [1];
               }
            /*-------------------------------------------------------*/
          }
      }
            /*-------------------------------------------------------*/
            /*              Update zero level                        */
            /*-------------------------------------------------------*/
      if (low pos[O] < zero _level)
        zero_level = low_Pos [01 ;
            /*-------------------------------------------------------*/
            /*              Update the Histogram                     */
            /*-------------------------------------------------------*/
#ifdef WMOPS
        WMP_cnt_test ( 8*N);
        WMPI_cnt_logic ( 4*N);
          WMP____Pnt.move ( N);
        WMP_cnt.add( N);
#endif
      for(i = 0; i < N; i++)
       {
        if((x_in [j] >= 12_neg) && (x_in [i] < 11_neg))
          hist [0] ++;
        else if((x_in [i] >= 11 neg) && (x_in [i] <0.0))
          list [1] ++;
        else if((x_in [i] >= 0.0) && (x_in (i] <= 11_pos))
          hist [2] ++;
        else if((x_in [i] > 11_pos) && (x_in [i] <= 12_pos))
          list [3] ++;
        else
          hist [4] ++;
      }
            /*-------------------------------------------------------*/
            /*                    Update the History                 */
            /*-------------------------------------------------------*/
#ifdef WMOPS
        WMP_cnt_Move((SE_MEM_SIZE_1)*4);
#endif
      for (i = SE_MEK_SIZE − 1; i > 0; i - -)
        {
        zero_rate [i] =          zero_rate [i − 1];
        low_rate [i] =           low_rate [i − 1];
        high_rate [i] =          high_rate [i − 1];
        zeroed [i] =             zeroed [i − 1];
        }
        /*-------------------------------------------------------------*/
        /*          Current Frame Rate Calculation                    */
        /*-------------------------------------------------------------*/
#ifdef WMOPS
          WMIP_cnt_test ( 3);
          WMIP_2cnt_move ( 3);
          WMP_cnt_add ( 1);
          WMP_cnt_div ( 3);
#endif
      if(hist [21 == N)
        zero_rate[0] = 1.0;
      else
        zero_rate [0] = (FLOAT64) hist [2] / (FLOAT64) N;
```

-continued

```
    if((hist [1] + hist [21] == N)
      low_rate [0] = 1.0;
    else
      low_rate [0] = (FLOAT64) (hist [1] + hist [2]) / (FLOAT64) N;
    if (hist [4] == N)
      high_rate [0] = 1.0;
    else
      high_rate [0] = (FLOAT64) hist [4] / (FLOAT64) N;
      /*-------------------------------------------------------------------*/
      /*                Silence Frame Detection                            */
      /*-------------------------------------------------------------------*/
#ifdef WMOPS
        WMP_cnt_test ( SE_MEM_SIZE*3) ;
          WMP_cnt_logic ( SE_MEM_SIZE*2);
        WMP_cnt_test ( 13);
        WMP_cnt_logic ( 9);
        WMP_cnt_move ( 6);
#endif
    idle_noise = 1;
    for (i = 0; i < SE_MEM_SIZE; i++)
      {
        if ((zero_rate [i] < 0.55) || (low_rate [i] < 0.80) ||
                    (high_rate [i] > 0.07))
                          idle_noise = 0;
      }
    cond1 =  ((zero_rate [0] >= 0.95) && (high_rate [0] <= 0.03));
    cond2 =  ((low_rate [0]>= 0.90) && (low_rate [1] >= 0.90) &&
             (high_rate [0] <= 0.030));
    cond3 =  ((low_rate [0] >= 0.80) && (low_rate [1] >= 0.90) &&
             (high_rate [0] <= 0.010)) && (zeroed [1] == 1));
    cond4 =  ((low_rate [0] >= 0.75) && (low_rate [1] >= 0.75) &&
             (high_rate [0] <= 0.004)) && (zeroed [1] == 1) );
             /*-------------------------------------------------------------*/
             /*      Modify the Signal if is a silence frame                */
             /*-------------------------------------------------------------*/
#ifdef WMOPS
        WMP_cnt_test ( 3);
      WMP_cnt_logic (4);
      WMP_cnt_mult ( 3*SE_RAMP_SIZE);
      WMP_cnt_add ( SE_RAMP_SIZE);
#endif
    if (cond1 || cond2 || cond3 || cond4 || idle_noise)
      {
      if (zeroed [1] == 1)
          /*-------------------------------------------------------------*/
          /*                Keep the Signal Down                           */
          /*-------------------------------------------------------------*/
          ini_dvector(x_out, 0, N-1, zero_level);
        }
      else
        {
          /*-------------------------------------------------------------*/
          /*                Ramp Signal Down                               */
          /*-------------------------------------------------------------*/
          for (i = 0; i < SE_RAMP_SIZE; i++)
            x_out [i] = ((FLOAT64) (SE_RAMP_SIZE - 1 -
            i) * x_in [i] +
                          (FLOAT64) i * zero_level) /
                            (FLOAT64) (SE_RAMP_SIZE -1);
            ini_dvector (x_out, SE_RAMP_SIZE, N-1, zero_level);
          }
          zeroed [0] = 1;
        }
      else if (zeroed [1] == 1)
        {
      /*-----------------------------------------------------------------*/
      /*                    Ramp Signal Up                                 */
      /*-----------------------------------------------------------------*/
          for (i = 0; i < SE_RAMP_SIZE i++)
              x_out [i] = ((FLOAT64) i * x_in [i] +
                          (FLOAT64) (SE_RAMP_SIZE - 1 - i) *
zero_level) /
                            (FLOAT64) (SE_RAMP_SIZE - 1);
          zeroed [0] = 0;
        }
      else
        zeroed [0] = 0
        {
      /*-----------------------------------------------------------------*/
```

-continued

```
      free_svector (hist 0 SE_HIS_SIZE - 1);
      free_dvector (max, 0, 1);
      free_dvector (mm, 0, 1);
      /*-----------------------------------------------------------------*/
      return;
      /*-----------------------------------------------------------------*/
    }
/*-----------------------------------------------------------------*/
```

The embodiments discussed in this invention are discussed with reference to speech signals, however, processing of any analog signal is possible. It also is understood the numerical values provided may be converted to floating point, decimal or other similar numerical representation that may vary without compromising functionality. Further, functional blocks identified as modules are not intended to represent discrete structures and may be combined or further sub-divided in various embodiments. Additionally, the speech coding system may be provided partially or completely on one or more Digital Signal Processing (DSP) chips. The DSP chip may be programmed with source code. The source code may be first translated into fixed point, and then translated into a programming language that is specific to the DSP. The translated source code then may be downloaded into the DSP. One example of source code is the C or C++ language source code. Other source codes may be used.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A speech coding system with input signal transformation, the speech coding system comprising:

an encoder disposed to receive an input signal, the encoder to provide a bitstream based upon a speech coding of a portion of the input signal, where the encoder adaptively tracks a zero-level and at least one quantization level of the input signal;

where the encoder calculates at least one silence detection parameter; and where the encoder compares the at least one silence detection parameter of the input signal to at least one threshold; and where the encoder ramps the input signal to the zero-level when the portion of the input signal comprises the silence noise.

2. The speech coding system according to claim 1, where the zero-level is one of 0 and 8.

3. The speech coding system according to claim 1, where the at least one quantization level comprises:

a smallest positive signal value;

a second smallest positive signal value;

a smallest absolute negative signal value; and a second smallest absolute negative signal value.

4. The speech coding system according to claim 1, where the at least one silence detection parameter comprises at least one frame rate.

5. The speech coding system according to claim 4, where the at least one frame rate comprises at least one of a zero_rate, a low_rate, and a high_rate.

6. The speech coding system according to claim 1, where the encoder ramps the input signal to the zero-level when a current portion of the input signal is a first silence portion.

7. The speech coding system according to claim 1, where the encoder maintains the input signal at the zero-level when consecutive portions of the input signal comprise silence noise.

8. The speech coding system according to claim 1, where the encoder ramps-up the input signal from the zero-level when a current portion of the input signal is a first non-silence portion.

9. The speech coding system according to claim 1, where the encoder maintains the input signal when consecutive portions of the input signal do not comprise the silence noise.

10. The speech coding system according to claim 1, where the speech coding comprises code excited linear prediction (CELP).

11. The speech coding system according to claim 1, where the speech coding comprises extended code excited linear prediction (eX-CELP).

12. The speech coding system according to claim 1, where the portion of the input signal is one of a frame, a sub-frame, and a half frame.

13. The speech coding system according to claim 1, where the encoder comprises a digital signal processing (DSP) chip.

14. The speech coding system according to claim 1, further comprising a decoder operatively connected to receive the bitstream from the encoder, the decoder to provide a reconstructed signal based upon the bitstream.

15. A method of transforming an input signal in a speech coding system, the method comprising:

adaptively tracking a zero-level and at least one quantization level of the input signal;

calculating at least one silence detection parameter;

comparing the at least one silence detection parameter to at least one threshold;

determining whether the input signal comprises a silence noise; and ramping the input signal to the zero-level when the input signal comprises the silence noise.

16. The method according to claim 15, further comprising:

determining whether a current portion of the input signal is a first silence portion when the current portion is determined to comprise the silence noise; and ramping the input signal to the zero-level when the current portion of the input signal is the first silence portion.

17. The method according to claim 16, further comprising maintaining the input signal at the zero-level when there are consecutive silence portions of the input signal.

18. The method according to claim 15, further comprising:

determining whether a current portion of the input signal is a first non-silence portion when the current portion is determined not to comprise the silence noise; and ramping-up the input signal from the zero-level when the current portion of the input signal is the first non-silence portion.

19. The method according to claim 18, further comprising maintaining the input signal when there are consecutive non-silence portions of the input signal.

20. The method according to claim 15, further comprising comparing the at least one silence detection parameter with the at least one threshold individually or in combination.

21. The method according to claim 15, further comprising: comparing the at least one silence detection parameter from the current portion of the input signal and from at least one preceding portion of the input signal with the at least one threshold.

22. The speech coding system according to claim 1, wherein the encoder calculates the at least one silence detection parameter based on the zero-level and the at least one quantization level, and wherein the encoder determines that the portion of the input signal comprises the silence noise based on comparing the at least one silence detection parameter of the input signal to the at least one threshold.

23. The method according to claim 15, wherein the calculating the at least one silence detection parameter is based on the zero-level and the at least one quantization level, and wherein the determining is based on the comparing.

* * * * *